US005478267A

United States Patent [19]

McDonald et al.

[11] Patent Number: 5,478,267

[45] Date of Patent: Dec. 26, 1995

[54] SOAP BUBBLE SENSING AND RESPONSIVE DEVICE

[75] Inventors: Gerald A. McDonald, 3 Oakes Ave., Gloucester, Mass. 01930; Ronald G. Magers, 5 Allen Ave., Manchester, Mass. 01944; Lee K. Wa, Hong Kong, Hong Kong

[73] Assignees: Gerald A. McDonald, Gloucester; Ronald G. Magers, Manchester, both of Mass.

[21] Appl. No.: 125,527

[22] Filed: Sep. 22, 1993

[51] Int. Cl.[6] ..... G08B 21/00; A63H 33/28; A63H 29/22; A63H 5/00

[52] U.S. Cl. ..... 446/15; 446/473; 446/484; 446/485; 446/404; 340/604

[58] Field of Search ..... 340/602, 604, 340/540; 446/15, 16, 17, 18, 19, 20, 21, 473, 484, 485, 404, 405, 406

[56] References Cited

U.S. PATENT DOCUMENTS

| | | | |
|---|---|---|---|
| 3,350,941 | 11/1967 | Misevich et al. | 340/602 X |
| 3,562,731 | 2/1971 | Hsu | 340/604 |
| 4,282,681 | 8/1981 | McCaslin | 446/484 |
| 4,547,169 | 10/1985 | Maxim | 446/484 X |
| 4,728,871 | 5/1988 | Andrews | 446/484 X |
| 4,773,888 | 1/1988 | Worsham et al. | 446/484 X |
| 5,023,560 | 6/1991 | Gallagher | 340/602 X |
| 5,035,665 | 7/1991 | Sheng | 446/15 |
| 5,083,965 | 1/1992 | Mayem | 446/484 X |
| 5,145,446 | 9/1992 | Kuo | 446/473 X |
| 5,259,807 | 11/1993 | Crow | 446/473 X |

FOREIGN PATENT DOCUMENTS

| | | | |
|---|---|---|---|
| 1331525 | 8/1987 | U.S.S.R. | 446/473 |
| 1428668 | 3/1976 | United Kingdom | 340/604 |
| 2221036 | 1/1990 | United Kingdom | 340/604 |

*Primary Examiner*—Robert A. Hafer
*Assistant Examiner*—D. Neal Muir
*Attorney, Agent, or Firm*—Pearson & Pearson

[57] ABSTRACT

An electronic soap bubble sensing and responsive device which is activated upon making contact between a soap bubble and an electronic sensor. The device consists of two electrodes mounted on a support frame and electrically coupled to internal electrical signal generation circuitry. The soap bubble sensor includes electrodes which are positioned so as to contact the soap bubble conjointly. Soap bubble fluid being conductive allows such contact to complete a trigger circuit, which contact also bursts the bubble, thereby breaking the circuit. The electrodes have a geometric configuration so as to maximum the conjoint contact with spherical bubbles, and the electrodes are supported on a frame so as to minimize wetting of the frame and triggering inadvertent activation. The completed electrical circuit can activate any sensory output as a result of the triggering, including sounds, lights or motion. Other sensors disclosed for discerning the presence of a soap bubble include impedance change of an antenna wire, optical sensing, magnetic sensing, and capacitive sensing.

2 Claims, 6 Drawing Sheets

SOAP BUBBLE SENSING AND RESPONSIVE DEVICE

BACKGROUND OF THE INVENTION

The present invention relates to an electronic entertainment device which is activated upon contact with a soap bubble and, more particularly to a device which, in response to soap bubble contact, generates electrical signals which may be converted to sound, light or kinetic sensory output augmenting the entertainment and recreational nature of the device.

Blowing soap bubbles has long been a source of entertainment and recreation for children. Various and sundry devices and improvements have been developed over the years to facilitate the creation of soap bubbles for entertainment. There exists, however, an unmet need to supplement a child's entertainment and recreation with soap bubbles by providing entertainment devices which may be used to pop or burst soap bubbles which were previously created, and thereby generate a sensory output which provides an additional source of entertainment for the child.

While there exist devices which upon contact with skin or other conductive matter will trigger an output, such devices are not specifically designed to reliably detect and discern soap bubbles. Moreover, these devices are not physically designed for such detection and will not shed bubble soap. It would therefore be desirable to have a device which can discern soap bubbles having physical dimensions to shed soap fluid for later re-triggering.

It would be further desirable, therefore, to create a soap bubble sensing and responsive device which provides audible, visual or motion responses. Such devices or toys may take on a number of embodiments, including that of a toy or magic wand, or even animals and insects, which generate sound, motion or visual responses or some combination thereof for entertainment of the child user. Additionally, it would be desirable to fashion such responses to particularized users or for particularized purposes. For example, it may be desirable to use audible responses which are fashioned particularly for either female or male children. Such particularized responses might also contemplate the use of varying sounds, either changing with each bubble popped or changing based upon the number of bubbles popped for the purpose of game or sport. For game purposes it might be desirable to have short audible tone bursts for each bubble detected/popped up to a predetermined threshold for winning (e.g., 10 bubbles), then a long tone burst might be sounded.

An object of the present invention is to solve an unmet need for soap bubble sensing and responsive devices.

Another object of the present invention is to provide an entertainment device in the form of a toy which may take on various shapes, including a toy wand, animal, insect, etc., which is used by a child to pop or burst soap bubbles and thereby provide entertaining sensory output.

A further object of the present invention is to provide a soap bubble sensing and responsive toy wand which generates sounds or voices responsive to soap bubbles popped by the wand, the wand having an electrical soap bubble sensor at its end where soap bubbles may complete an electronic trigger circuit and the wand also having a soap bubble creation loop disposed within its handle portion.

Additional objects and advantages of the invention will be set forth in part in the description which follows and in part will be obvious from the description and may be learned by practice of the invention. The objects and advantages of the invention will be realized and attained by means of the elements and combinations particularly pointed out in the appended claims.

SUMMARY OF THE INVENTION

To achieve the objects and in accordance with the purposes of the invention, as embodied and broadly described herein, the soap bubble sensing and responsive device has a sensor for discerning the presence of a soap bubble, structured either as part of the soap discerning sensor or as separate structure for breaking the sensed soap bubble, and a signal generating source responsive to bubbles discerned with the soap bubble sensor for generating an electrical signal output. The electrical signal generated responsive to soap bubble sensing is then coupled within the device to sensory output which may include sounds, lights or motion. A bubble creation or blowing loop may be included within the device.

It is to be understood that both the foregoing general description and following detailed description are exemplary only and are not restrictive of the invention, as claimed.

The accompanying drawings which are incorporated in and constitute a part of the specification illustrate various embodiments of the invention and together with the description serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
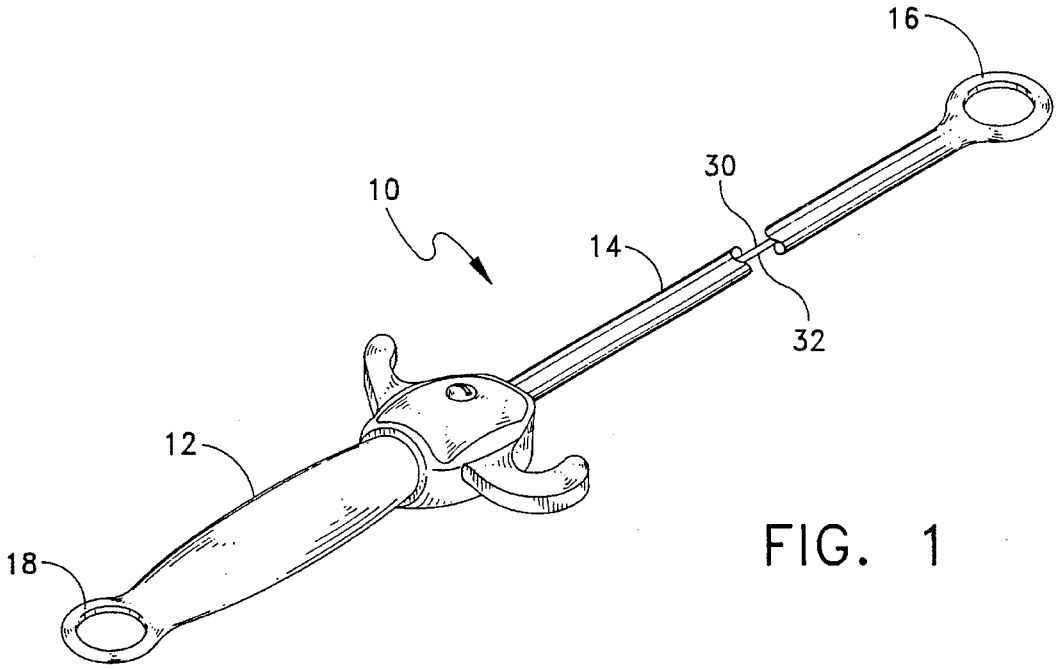
FIG. 1 is a perspective view of a soap bubble sensing and responsive toy magic wand device in accordance with the present invention.

As depicted in FIG. 1, a soap bubble sensing and responsive device is illustrated in the form of a magic bubble wand 10 including a handle 12 and an elongated portion 14 attached to the handle 12. The wand 10 is typically about 20 inches long. A soap bubble sensor 16 is disposed at the end of the elongated portion 14, and a bubble ring is disposed within the wand handle 12.

The wand embodiment of FIG. 1 illustrates a generic type toy magic wand for entertainment recreation by soap bubble sensing and bubble bopping, popping or bursting. Embodiments may be stylized particularly for girls and boys which may be colored pink and blue accordingly. In addition to being referred to as a wand, the device may also be referred to as a bubble bopper.

Figure 2:
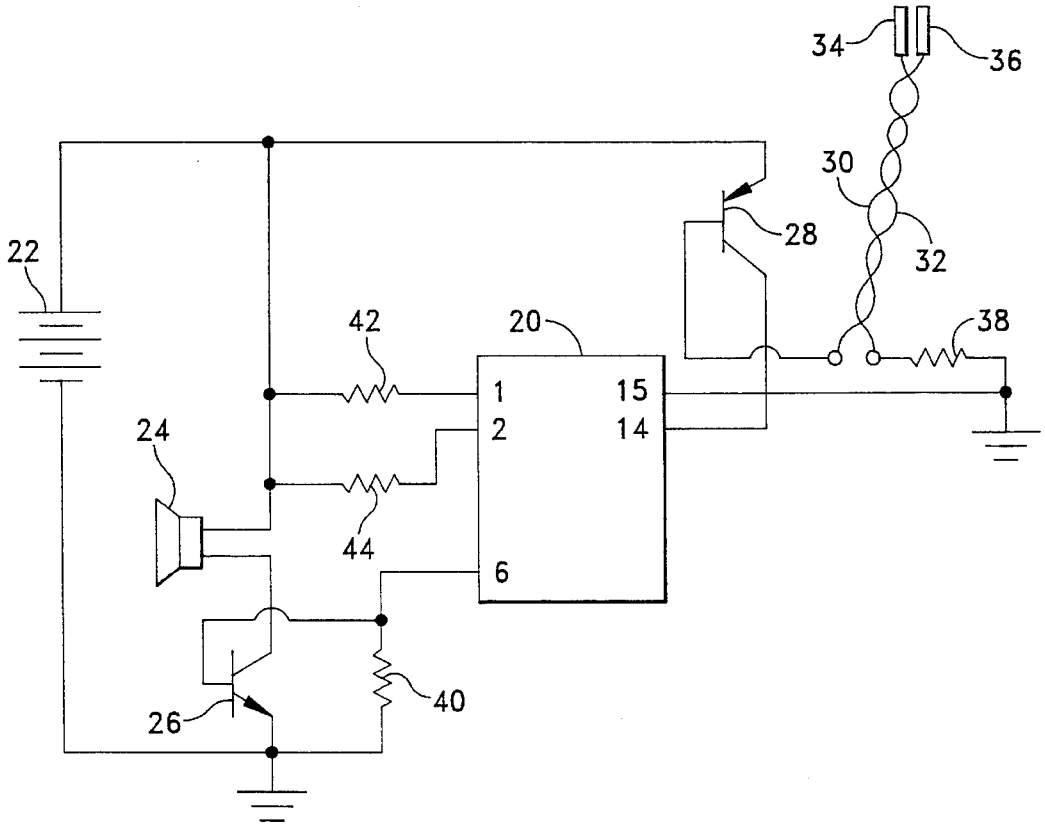
FIG. 2 is an electronic schematic diagram used for sensing bubbles and generating electrical signals creating audible sounds responsive thereto.

Turning now to FIG. 2, exemplary electronic circuitry use in embodiments of the invention is illustrated in schematic form demonstrating the way in which soap bubble detection triggers electronic signals that may be converted to audible signals such as tones, music or voice. The schematic diagram of FIG. 2 employs a voice chip 20 which is an integrated circuit which generates a series of user defined voice signals preprogrammed into the voice chip 20. In the preferred embodiment, the voice chip 20 employed is the MOSEL MSS0303 VOICE ROM, which is a single-chip CMOS VLSI ROM that can store up to three seconds of audible information using the MOSEL qualified coding method (MPCM). The MOSEL VOICE ROM will be described in further detail with reference to FIG. 6 which depicts its internal workings.

Alternatively, the voice chip 20 may be substituted with any electrical signal, tone or audible noise generating device having a trigger input. For example, an early embodiment of the present invention employed the popular 555 timer chip for tone generation responsive to sensed bubbles. Any other tone generating device will also suffice. The soap bubbles sensing and responsive circuitry is powered by a battery 22 which may comprise a single battery or a number of batteries in series. In the preferred embodiment, two (2) AAA batteries are used for an operating voltage of 2 volts to 3.4 volts. Maximum operating current at 3.4 volts is 85 milliamps and maximum standby current at 3.4 volts is 6 microamps.

A speaker 24 is employed for converting the electrical signals generated by the voice chip 20 into audible sounds. The speaker 24 is housed within a speaker housing of the device which will be illustrated further below.

A 27 mm diameter, 32 ohm speaker has been found satisfactory for use in the various embodiments described herein. The speaker 24 is driven by a transistor 26 having its base element connected to the audio signal current output lead of the voice chip 20, pin 6, which delivers current through a resister 40 (820 ohm in one embodiment) to create a voltage drop across the resister 40. The positive power supply pin of the voice chip 20, pin 1 is connected to the positive end of the battery via a pullup resistor 42 (100 ohm in one embodiment). The oscillator enable input of the voice chip 20, pin 2 is tied high via a pullup resistor 44 (510 kohm in one embodiment).

The voice chip 20, as utilized, is triggered when a soap bubble is detected via trigger inputs, here the trigger input employed is the "one-key" function input, internal pull-low, active high (OKY) input, pin 14, which is pulled up to a high trigger potential by a transistor 26 having sufficient gain to trigger the voice chip 20. A bubble sensor is connected at the base of the transistor 28. A pair of electrical wires 30 and 32 extend from the trigger circuitry to the soap bubble sensor, herein a pair of electrical contact plates 34 and 36. It is desired that the above means provide the ability to discriminate soap bubbles from other material, and thus the described circuitry was designed with this goal in mind. When a bubble is detected by completing an electrical circuit across the plates 34 and 36, current is drawn from the base of transistor 28 through the wires 30 and 32, the plates 34 and 36 via the soap bubble and through a resistor 38 (1 Mohm in one embodiment) to a ground potential.

Responsive to current drawn from the base of the transistor 28, the transistor 28 turns on pulling pin 14 of the voice chip 20 high, thus triggering electrical signal generation of a voice pattern to the speaker 24. The particular voice pattern may be customized for a particular embodiment. The same pattern may be repeated or alternatively, several patterns may be stored and sequenced either in a particular order or randomly as the voice chip 20 is triggered by soap bubbles.

Figure 4:
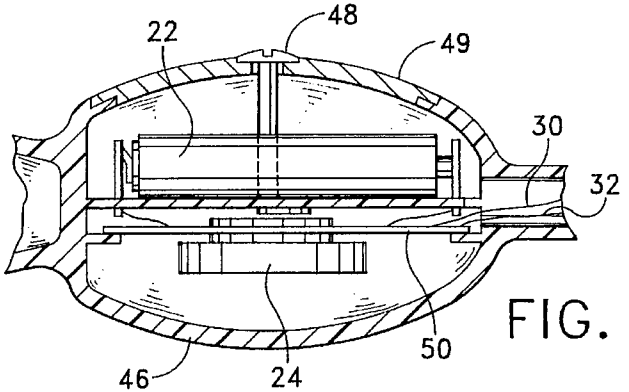
FIG. 4 is an enlarged cross-sectional view of the wand housing for battery powered electronic circuitry and audio speaker.
Figure 3:
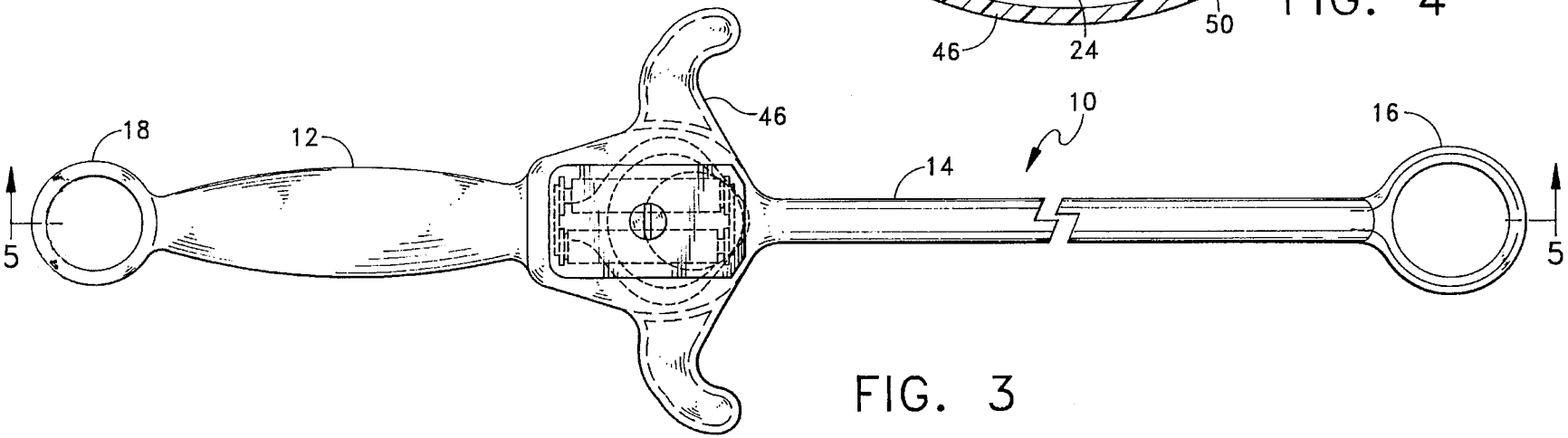
FIG. 3 is a plan view of the soap bubble sensing wand.

A plan view of the bubble bopper toy wand embodiment is shown in FIG. 3. A housing for the battery, circuitry and speaker is disposed within the toy wand at 46. FIG. 4 shows an exploded cross-sectional view of the wand housing for the battery powered electronic circuitry and audio speaker. The housing 46 may be closed and secured with a locking screw 48. Accordingly, the housing 46 may be opened by turning the locking screw 48, removing a housing cover 49 and then removing the batteries 22. A circuit board 50 is shown in FIG. 4 within the housing 46 and supporting the speaker 24. The wires 30 and 32 are connected to the circuit board 50 and extend outward along the wand's elongated portion to the bubble sensor.

Figure 5:
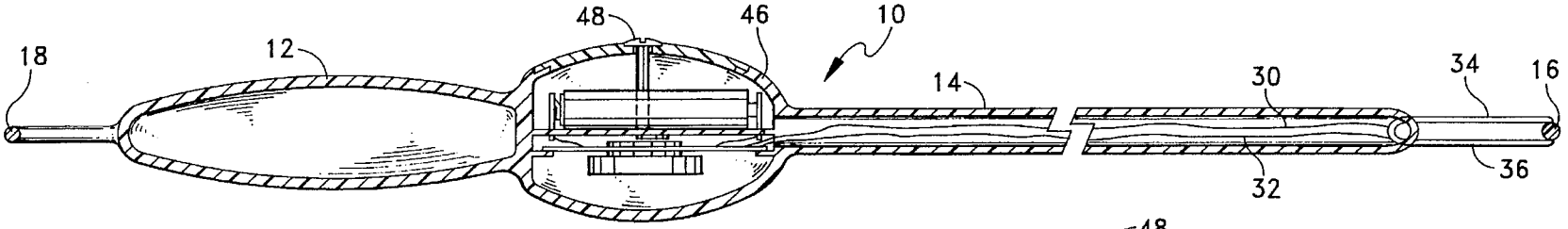
FIG. 5 is a cross-sectional view of the bubble sensing wand lengthwise according to line 5—5 of FIG. 3.

FIG. 5 shows a cross-sectional view of the bubble sensing wand lengthwise according to line 5—5 of FIG. 3. With the cross-sectional view of FIG. 5, it should be noted particularly the way in which the contact plates 34 and 36 are disposed in the bubble sensor 16 at the end of the wand elongated portion 14. The bubble sensor 16 and associated contact plates 34 and 36 will be discussed in more detail in conjunction with FIGS. 7 and 8. It should be noted, however, that alternate soap bubble sensing means are contemplated for use within alternative embodiments of the present invention.

Several other sensing means may be employed to accomplish the desired bubble sensing in accordance with the invention. Such sensing means include that of impedance change, optical sensing, magnetic sensing and capacitive sensing, among others.

For an impedance change, a shift in the impedance of an exposed antenna wire may be sensed to ascertain the presence of a soap bubble. With such a single antenna wire it would be desirable, however, to mount the antenna wire so as shed bubble fluid quickly in order to reset inductive triggering of the soap bubble sensing and responsive device. An optical sensor would be able to distinguish differences in light or the reflected light off a bubble film with a photosensitive diode or other light sensitive device. Since the soap bubble fluid is conductive, an antenna would also be able to sense a change in a local magnetic fluid induced by a second circuit generating magnetic flux. The local magnetic flux would be modified by transmittance through the conductive film of the soap bubble fluid. A capacitive sensor embedded in plastic would also be able to sense the presence of a soap bubble. While optical, magnetic, capacitive or inductive sensors are viable means for sensing the presence or absence of a soap bubble, the preferred embodiment of the bubble sensor described herein employs the pair of electrically conductive plates 34 and 36 in the form of concentric rings, which are discussed further in the discussion that follows.

Figure 6:
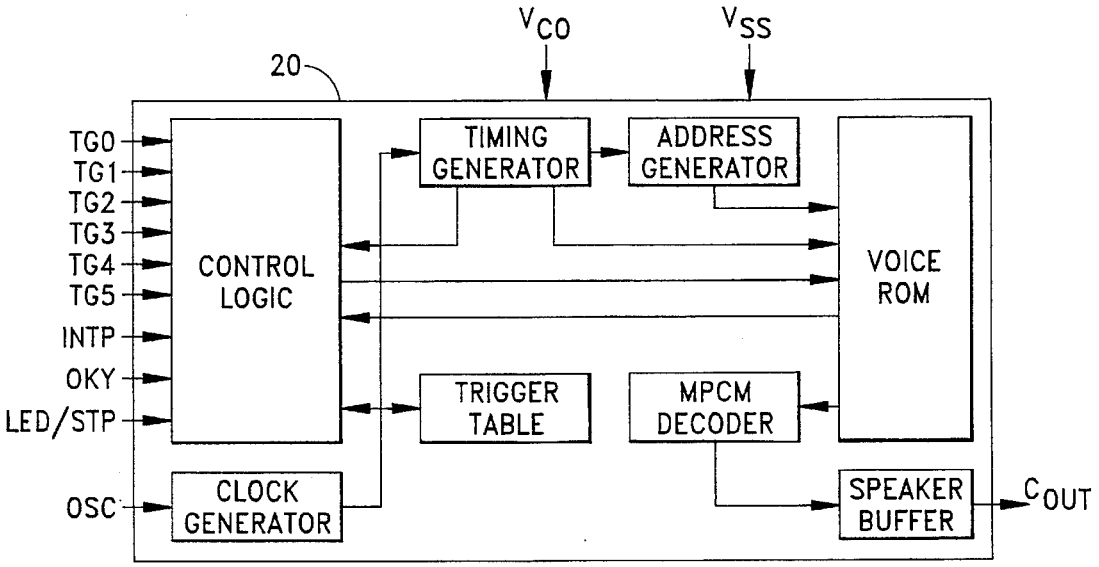
FIG. 6 is a block diagram showing internal circuitry associated with integrated circuit signal generation electronics used within the soap bubble sensing and responsive device.

The voice chip 20 illustrated in block diagram form in FIG. 6 is the MOSEL single-chip CMOS VLSI ROM, voice chip 20 discussed, which stores up to three seconds of voice information which may be provided to Mostel for custom applications. Girls' sounds that are stored in the girls' version of the bubble bopper wand, including what may be referred to as musical, magical bubble sounds such as "ping", "ding" and "tinkle." Boys' bubble bopper wands may include what are referred to as battling bubble sounds including "pow", "crash" and "boom".

The Mosel MSS0303 VOICE ROM integrated circuit chip may operate at both voltages of 2.4 volts through 6 volts. Current output of the integrated circuit could drive an 8 ohm speaker with a transistor, however, it has also been found advantageous to use a 32 ohm speaker in an embodiment. The custom voice content which may be stored includes up to three seconds of voice which can be separated into six sections. Then, six trigger input pins are provided, each of which can access a phrase instead of a simple section. A phrase is composed of one or more sections as a combination of sections. The total step number of all phrases is up to 64. Total duration of all sections with mute is up to 24 seconds.

While sections and phrases may be triggered individually with corresponding pins, in the embodiments disclosed herein individual trigger inputs for phrases or sections are not utilized, but rather a play-all function "one-key" OKY plays all six phrases one by one with a single trigger input, herein pin 14. Accordingly, as bubbles are sensed and the OKY pin 14 is pulled low to trigger the voice chip 20, all preprogrammed voices are sequenced through to provide audible entertainment. The sequential function of the OKY pin allows one trigger to play the next phrase of six phrases circularly.

An LED function provided by the MSS0303 VOICE ROM which is not employed in the illustrated embodiments could be used to optically indicate a 6 hertz flash to indicate the audio status. The LED function may also be employed for a separate source of visual output independent of other sensory outputs.

As can be appreciated from FIG. 6, most of the necessary circuitry for sound generation, including an oscillator, ROM, DAC and interface logic, are built into the voice chip 20. Accordingly, versatile functions can be performed with a minimum of external components. Custom voice data can be edited and built in by mask programming during the device fabrication, so custom voice sequences do not require additional external circuitry or memory storage.

Figure 7A:
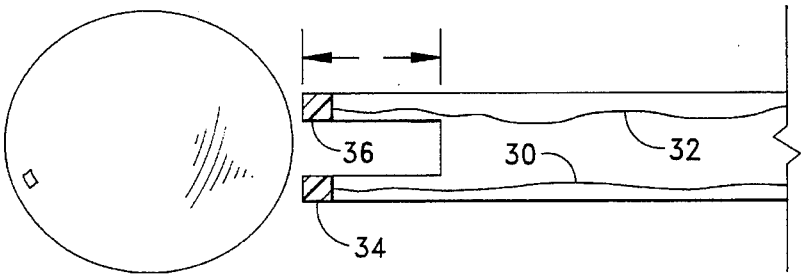
FIGS. 7A–7D illustrate, in cross section, various soap bubble sensing schemes employing electrically conductive contact pairs.
Figure 7B:
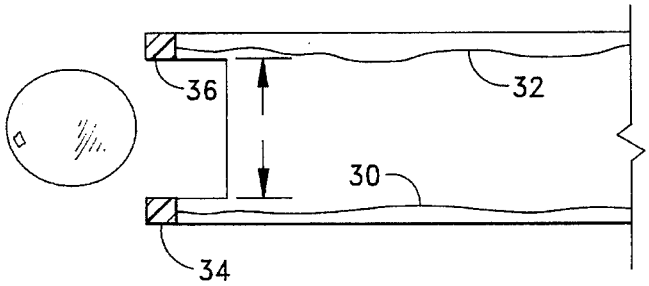
Figure 7C:
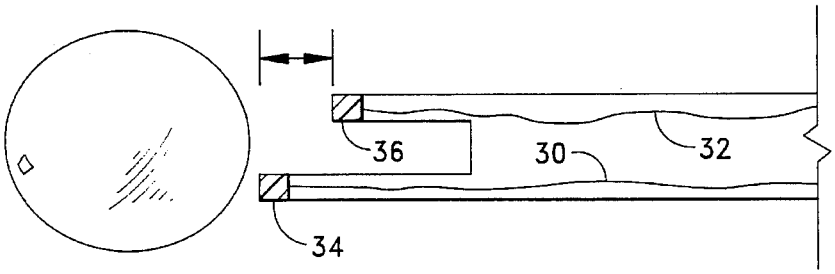
Figure 7D:
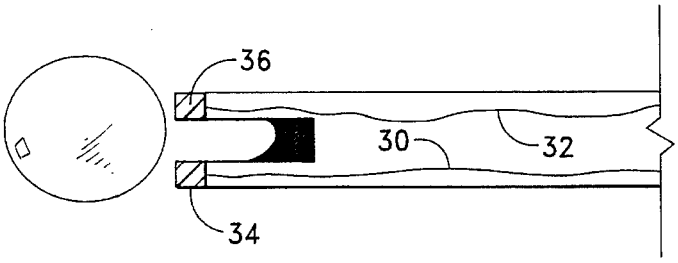

FIGS. 7A–7D and FIGS. 8A–8D illustrate the preferred bubble sensor employing spaced-apart concentric ring electrical contact plates. As can be appreciated by FIG. 7A, in cross section, the contact plates are separated, yet sufficiently close together to allow for simultaneous contact by an incident bubble. Skin contact, however, is not intended to trigger the device. Dry skin contact should not false trigger, but of course wet skin contact or bringing the plates into contact with any conductive surface or material will, however, false trigger the device. A groove is provided between the contact plates. The length of the groove, insulated separation between metal contacts, must be long enough to prevent build-up of creeping soap bubble solution left over from previously broken bubbles, in order to prevent false triggering. FIG. 7B illustrates that, if the contact plates are spaced too far apart, simultaneous contact of the bubble surface incident on the plates may not be possible. FIG. 7C illustrates that an offset of the plates may be desirable if bubbles are moving towards the contacts at an angle (e.g., 45°). FIG. 7D illustrates a build-up of soap bubble solution in the gutter between the plates. The distance between the contact plates should be as close together as possible, to ensure both contact with the soap bubbles at the same time, but not so close to permit a build-up of residue of bubble fluid between the contacts due to surface tension. Further, the depth of the non-conductive insulating channel must be deep enough or configured with a gutter, to avoid build-up of fluid out as far as the contact plates where build-up at that point will cause completion of the circuit and therefore false triggering.

Figure 8A:
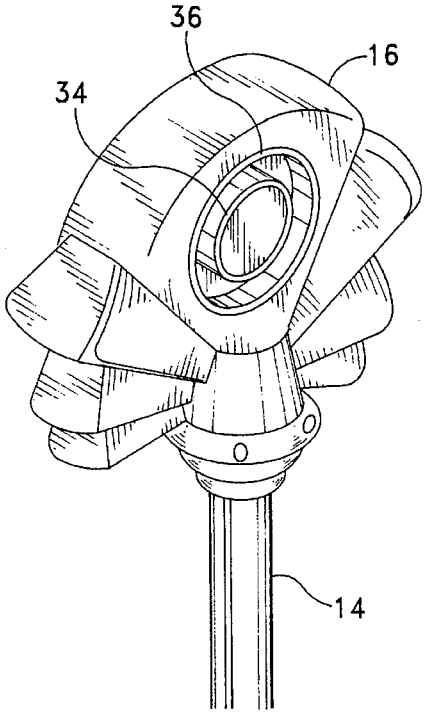
FIGS. 8A–8D are perspective and cross-sectional views of a toy wand end design having concentric soap bubble sensor contacts disposed therein.

The contact plates 34 and 36 may be spaced apart parallel flat plates which were utilized in some embodiments, as illustrated by the flat rings shown at sensor 16 in FIGS. 1, 3 and 5. However, the preferred embodiment of the soap bubble sensing contact plates 34 and 36 are illustrated in FIGS. 8A–8D wherein plates 34 and 36 are concentric conductive rings disposed on both sides of the sensor 16. FIG. 8A provides a perspective view of the sensor 16 and associated contact plates 34 and 36 at the end of the elongated portion 14 of the bubble wand 10. The soap bubble sensor 16 as depicted in FIGS. 8A–8D are preferred over the sensor illustrated in FIGS. 1, 3 and 5 because metal contacts are not disposed around the end of the sensor where they may pose a threat to other children during play. The preferred embodiment of FIGS.8A–8D provide the metal contacts at the center of and on both sides of the sensor 16, rather than at its very end. Further in accordance with the preferred embodiment, the metal contact rings are silver plated and the central portion inside the inner contact ring of plate 34 has a plastic cap, which may be of any appropriate color. When assembled, children can only see two tiny, thin silver metal rings housed within the plastic housing of sensor 16.

Figure 8B:
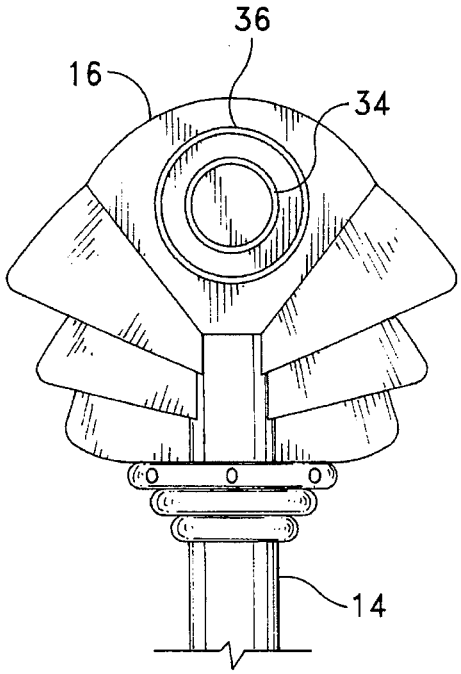
Figure 8C:
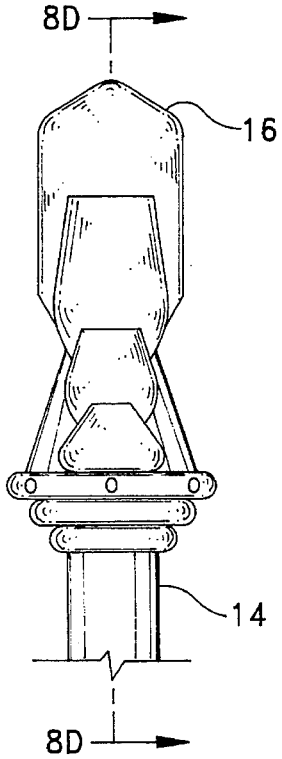
Figure 8D:
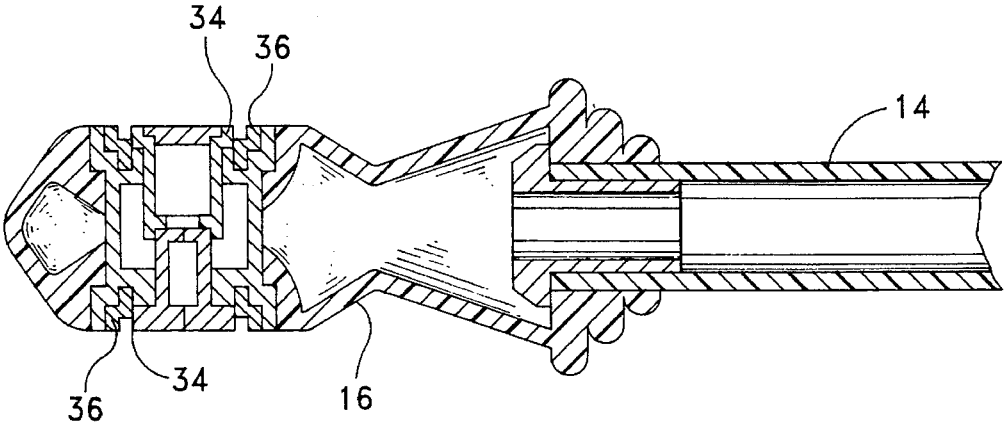

FIGS. 8B and 8C illustrate the front and side views of the sensor 16, respectively. FIG. 8D illustrates the bubble sensor 16 in cross section along the line 8D—8D of FIG. 8C. Note particularly in FIG. 8D that the concentric conductive plates 34 and 36 are disposed on both sides of the sensor 16. Further note the stepped trough between the contact plates 34 and 36 which prevent shorting of the contact plates as discussed in FIG. 7 above. In the embodiment of FIGS. 8A–8D, the contact plates 34 and 36 are approximately 0.3 to 0.5 mm in thickness, the inner ring of contact plate 34 being about 11 to 15 mm in diameter and the outer ring of contact plate 36 being about 18 to 23 mm in diameter. The spacing between plates 34 and 36 is preferably on the order of about 2.5 to 5.0 mm. The contact plates 34 and 36 may extend outward from the bubble sensor 16 approximately 1 mm from the plastic housing.

Figure 9:
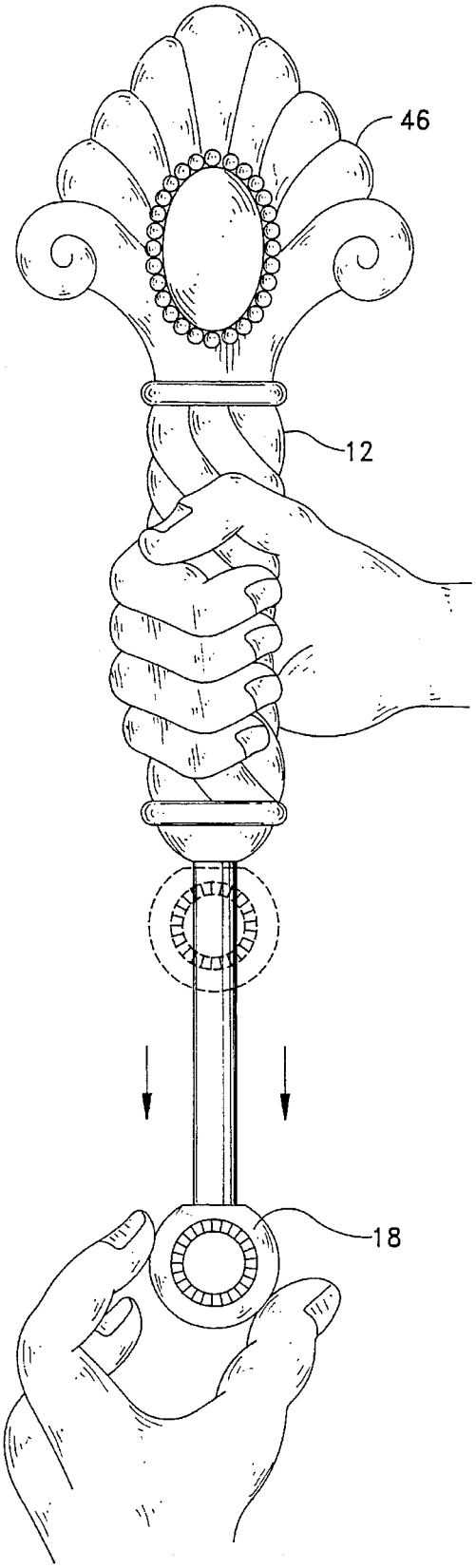
FIG. 9 is a view of the wand handle and speaker housing showing a telescoping bubble ring or loop disposed within the wand handle which may be extended by pulling out the bubble ring from the handle.
Figure 10:
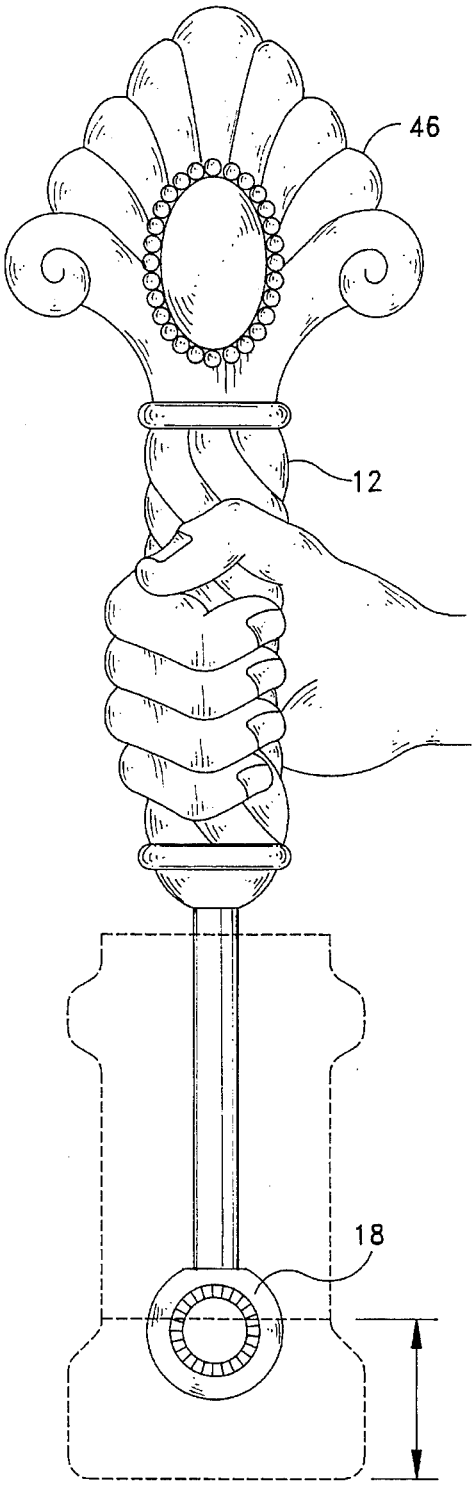
FIG. 10 shows a view of the wand handle and speaker housing wherein the bubble ring or loop is extended, allowing it to be dipped within a bottle of soap bubble solution shown in dashed lines.

FIGS. 9 and 10 illustrate the bubble ring 18 disposed within the handle 12 wherein a telescoping action is provided to extend the bubble ring 18, allowing it to be easily placed within a bottle of bubble solution as illustrated in FIG. 10. Accordingly, as illustrated in FIGS. 9 and 10, the bubble ring 18 is provided as an extendable and retractable member incorporating the bubble ring at one end and is mounted at the other end to move inwardly or outwardly relative to the handle 12.

Other embodiments of the present invention will be apparent to those skilled in the art from consideration of the specification and practice of the invention disclosed herein. It should therefore be appreciated that the disclosed device may be embodied in any toy in a variety of shapes which may include animals or insects such as bumblebees in addition to toy wands. In particular, in an early embodiment of the invention, the soap bubble sensing and responsive device was disposed within a toy bumblebee with its antennae as the soap bubble sensor. A game was developed whereby short tone bursts (buzzes) were generated for each bubble sensed. When ten (10) bubbles were sensed, then a long tone burst (buzz) indicated that the child won the game. It is intended that the specification and examples be considered as exemplary only with a true scope and spirit of the invention being indicated by the following claims.

What is claimed is:

1. A toy for swinging by a child into contact with a soap bubble to burst the same and to signal the child that the bubble has been hit and burst, the toy comprising:

a body for gripping by the child;

a sensor on the body for sensing contact with the bubbles;

a signal generator operable by the sensor to generate a signal which informs the child that the bubble has been hit and burst; and a bubble ring carried on the body for making bubbles from a soap solution.

2. A toy in accordance with claim 1 in which an extendable and retractable member carries the bubble ring at one end and is mounted at the other end to move inwardly or outwardly relative to the body.

* * * * *